United States Patent [19]

Reiback

[11] 4,139,955

[45] Feb. 20, 1979

[54] DISPLAY DEVICE

[76] Inventor: Earl M. Reiback, 20 E. 9th St., New York, N.Y. 10003

[21] Appl. No.: 674,920

[22] Filed: Apr. 8, 1976

[51] Int. Cl.[2] ..... G09F 13/12; G09F 19/16

[52] U.S. Cl. ..... 40/427; 40/219; 350/290; 362/140; 362/811

[58] Field of Search ..... 40/106.52, 106.53, 133 A, 40/132 E, 132 D, 219, 130 D, 130 L, 152.2, 130 R, 130 B, 132 R, 28 B, 427, 442; 240/10 R, 10 L, 10.1, 10 T; 272/8 M, 8 D, 8 R; 350/291, 293, 290, 296; 362/135, 140, 806, 811

[56] References Cited

U.S. PATENT DOCUMENTS

| | | | |
|---|---|---|---|
| 1,807,374 | 5/1931 | Bowerman | 40/130 C X |
| 2,056,383 | 10/1936 | Benway | 40/219 |
| 2,221,889 | 11/1940 | White | 40/219 |
| 2,222,301 | 11/1940 | Rappaport | 40/563 X |
| 2,286,246 | 6/1942 | Yearta | 40/219 |
| 2,286,247 | 6/1942 | Yearta | 40/28 B X |
| 2,411,955 | 12/1946 | Colbert et al. | 350/290 X |
| 2,607,145 | 8/1952 | Pope | 40/130 B |
| 3,452,456 | 7/1969 | Tinman | 40/130 D |
| 3,527,527 | 9/1970 | Manowitz | 350/293 X |
| 3,806,722 | 4/1974 | Peake et al. | 240/10 R |
| 3,915,457 | 10/1975 | Casey | 350/293 X |

FOREIGN PATENT DOCUMENTS

| | | | |
|---|---|---|---|
| 301686 | 12/1928 | United Kingdom | 40/219 |
| 320979 | 11/1929 | United Kingdom | 40/564 |
| 327870 | 4/1930 | United Kingdom | 40/564 |
| 1229912 | 4/1971 | United Kingdom | 40/219 |
| 1229910 | 12/1972 | United Kingdom | 40/564 |

*Primary Examiner*—John F. Pitrelli

*Attorney, Agent, or Firm*—Hubbell, Cohen, Stiefel & Gross

[57] ABSTRACT

A display device which imparts to the observer an illusion of depth. The device includes a partially silvered front mirror, illuminating means disposed behind this front mirror, and a fully silvered rear mirror positioned behind the illuminating means such that its reflective surface is parallel to and facing the partially silvered front mirror. The illusion of depth results from the successive reflections of the light from the illuminating means between the two mirrors, establishing a series of virtual images which appear to extend back into the device.

22 Claims, 18 Drawing Figures

FIG. 8.
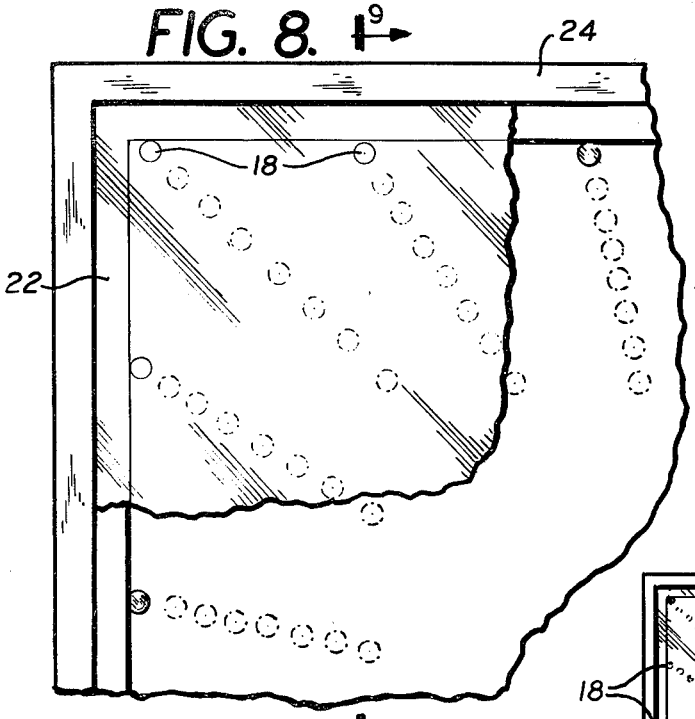
FIG. 11.
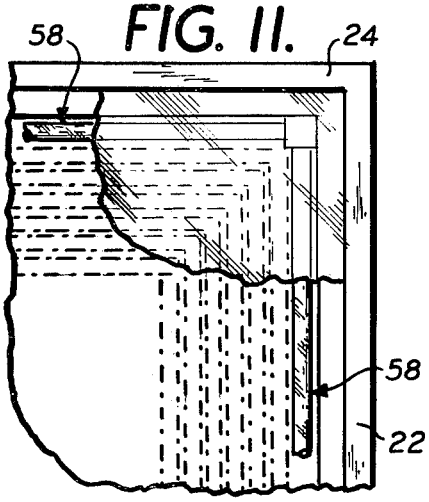
FIG. 12.
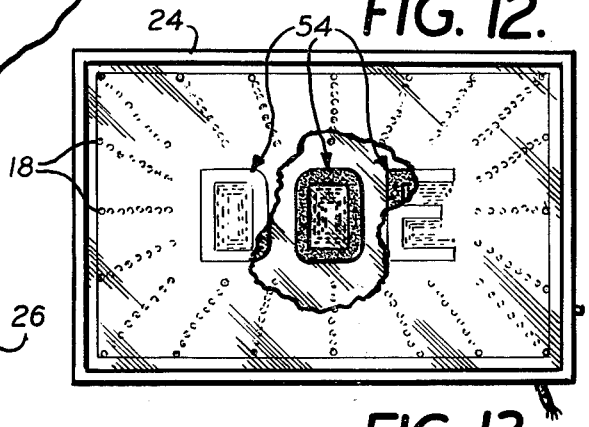
FIG. 9.
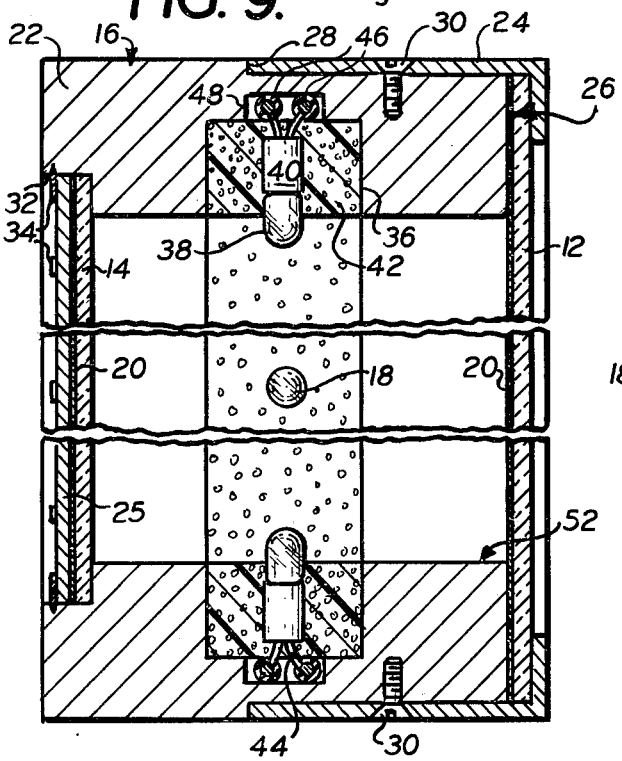
FIG. 13.
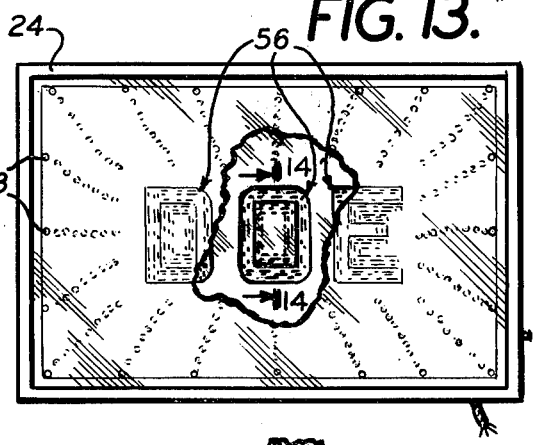
FIG. 10.
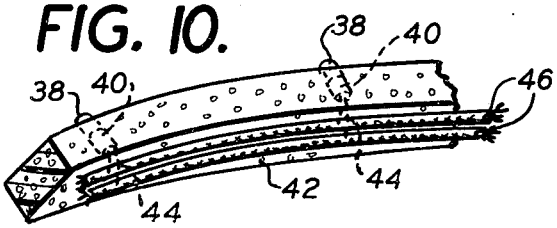
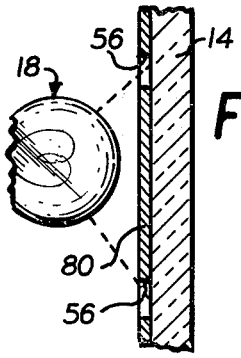
FIG. 14.

DISPLAY DEVICE

BACKGROUND OF THE INVENTION

A. Field of the Invention

This invention relates to display devices and especially to display devices employing the phenomenon of multiple reflections.

B. The Prior Art

U.S. Pat. No. 3,610,918 discloses a cube, all of the sides of which consist of partially silvered mirrors, with illuminating means disposed inside of the cube.

In addition, the laser, a well known light amplification device, takes advantage of the phenomenon of multiple reflections.

BRIEF SUMMARY OF THE INVENTION

This invention relates to an apparatus for a display device the object of which is to impart to the observer an illusion of depth.

The illusion is accomplished by the use of a first partially silvered mirror which forms the front, or viewing surface of the device; a second fully silvered mirror positioned behind and generally parallel to the first; and illuminating means disposed between the two mirrors.

In operation, the successive reflections of the illuminating means between the two mirrors create a series or virtual images of said illuminating means, the first such reflection corresponding to the first virtual image, the second reflection corresponding to the second virtual image, appearing behind the first, and so on, the multiple virtual images appearing to extend back into the device and imparting to the observer an illusion of depth. The observer is able to see these images by virtue of the light transmitted through the partial mirror which forms the front, or viewing side of the device, while at the same time seeing his own image as reflected by this mirror.

Since on each successive reflection a certain amount of light is transmitted through the partially silvered front mirror, the resulting virtual images becomes increasingly faint. Therefore, the actual degree of the illusion created is dependent upon the intensity of the illuminating means, the reflectivity of the partially silvered front mirror, the absorbtivity of the transparent substrates (e.g. glass), the amount of losses encountered in each reflection, and the ambient light. The type of illuminating means selected may also be varied in order to alter the visual effect produced.

By applying a dichroic coating or a transparent color to either of the two mirrors, or by using tinted transparent substrates, the virtual images will appear to change in color, further enhancing the visual effect of the device.

Further features of the apparatus according to the invention will become apparent from the following detailed description and annexed drawings, which disclose certain non-limiting examples of embodiments preferred at present.

BRIEF DESCRIPTION OF DRAWINGS

FIG. 8 is a fragmentary front elevational view with parts broken away to more adequately illustrate the invention;

FIG. 9 is a sectional view taken along the line 9—9 in FIG. 8;

FIG. 10 is a fragmentary perspective view of the preferred means for supporting the bulbs in the display device of the present invention;

FIG. 11 is a fragmentary front elevational view similar to FIG. 8 but showing a modified form of illuminating means;

FIG. 12 is a view similar to FIG. 1 but showing indicia suspended within the device;

FIG. 13 is a view similar to FIG. 12 but showing indicia etched in the reflective coating on the rear mirror of the display device;

FIG. 14 is a sectional view taken along the line 14–14 in FIG. 13;

DETAILED DESCRIPTION OF THE PREFERRED EMBODIMENT

Figure 1:
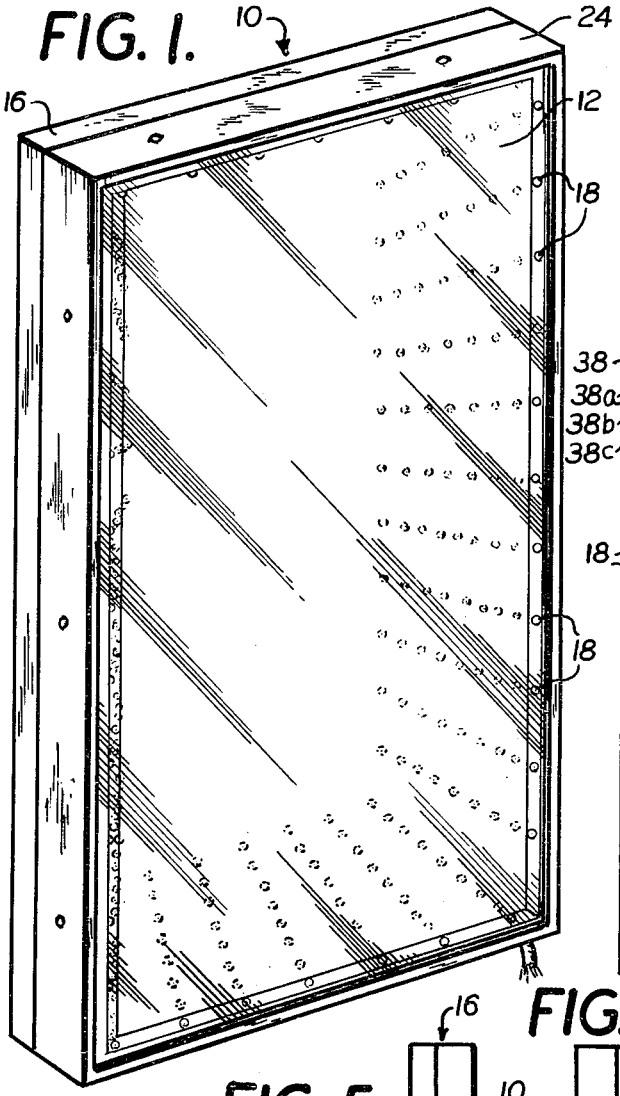
FIG. 1 is a perspective view of a display device embodying the present invention with the illuminating means energized.

Referring now to the drawings in detail and particularly to FIGS. 1 and 9 thereof, a display device apparatus embodying the present invention is generally designated by the reference numeral 10. Apparatus 10 includes a preferably planar partially silvered front mirror 12, a preferably planar fully silvered rear mirror 14, said rear mirror being in spaced apart parallel relation to the mirror 12, a housing means 16 for supporting the mirrors in their defined relation, and illuminating means 18 operatively connected to and within the projected area of the mirrors 12 and 14.

Figure 18:
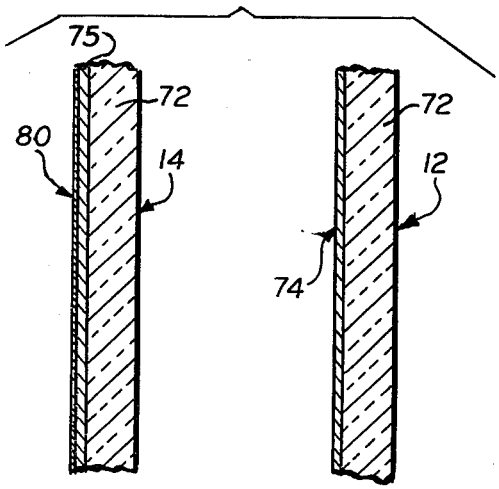
FIG. 18 is a fragmentary sectional view showing a preferred construction for the mirrors.

According to the invention, a "partially silvered" mirror is one which will reflect a certain percentage of the light incident upon it while transmitting substantially all of the remainder, a small amount of absorption and other losses being unavoidable. Such a mirror may be constructed in a number of ways well known to those skilled in the art, such as by convering one side of a transparent ssustrate such as, for example, glass or plastic, with a reflective coating of, for example, silver or aluminum or, as will be more fully discussed hereinafter, by applying a dichroic coating to the substrate. Such coatings may be applied in any well known manner, such as, for example, vapor deposition. The relative amounts of light reflected and transmitted by the mirror are dependent on the reflectivity of the coating applied to the substrate. As shown in FIG. 18, the mirror 12 is a planar piece of glass 72 with a partially reflective silver coating 74 applied to its rear surface. However, the term "partially silvered" as used above is not intended to limit the mirror to one in which a transparent substrate is coated with silver, since, as noted above, any reflective coating, such as, for example, aluminum will suffice. Rather, the term is used generically to describe a mirror having the above described optical properties.

As presently preferred and for reasons that will become apparent hereinafter, the mirror 12 should reflect not less than about 50% and not more than about 95% of light incident upon it, with about 90% reflection being preferred.

A "fully silvered" mirror is one which reflects substantially all of the light incident upon it, small losses due to absorption and reflection being unavoidable. The construction of a fully silvered mirror is similar to that of a partially silvered one except that in the case of a fully silvered mirror a denser reflective coating is applied and in addition, an opaque coating 80 is applied to the rear surface of the mirror. This opaque coating may be applied in any number of well known ways, such as, for example, and as presently preferred, by painting the rear surface of the mirror a mat black. As shown in FIG. 18, the mirror 14 is a planar piece of glass 72 with a substantially fully reflective coating 75 and black mat finish 80 applied to its rear surface. It is pointed out that the term "fully silvered" is merely intended as a generic designation for mirors having the above described optical properties and is not intended to limit the method of construction of such a mirror nor the composition of the coating.

As previously noted, housing means 16 supports the mirrors 12 and 14 in a spaced apart generally parallel relation. Numerous ways of constructing a suitable housing means are obvious to one skilled in the art, and any may be used.

As shown, housing means 16 includes a rectangular shaped member 22 of wood, plastic, metal or other suitable material, having a substantially rectangular cross-section, framing member 24 having a shape corresponding to the shape of housing means 16 and an L-shaped cross-section, and a rectangularly shaped backing piece 25. Preferably, member 22 is made of wood and framing member 24 is made of metal such as aluminum, although other suitable materials may be employed for either or both parts. Backing piece 25 is made perferably of cardboard, pressboard, hardboard or the like. Mirror 12 is peripherally secured between the front surface 26 of member 22 and the inside of the vertical portion of framing member 24. Preferably, and as shown, at the front and along the entire outer surface of the member 22 is a recess 28 which recess is substantially equal in thickness to framing member 24 so that when fitted together, framing member 24 will be flush with the outer surface of member 22. As presently preferred, framing member 24 is secured to member 22 by a plurality of distributed screws 30 or other fasteners. At the rear of and along the entire inner surface of member 22 is a continuous recess 32 for accommodating the periphery of the mirror 14. As shown, mirror 14 is placed in the recess 32 such that its uncoated surface faces the front mirror 12. Directly behind mirror 14 and in surface contact therewith is the backing piece 25. As shown and presently preferred, the cardboard 25 is secured to member 22 by a plurality of distributed triangular nails 34, or other fasteners obvious to one skilled in the art, such that mirror 14 is held firmly in place in recess 32 between the member 22 and the backing 25 (FIG. 9).

The illuminating means 18 may take any number of forms, all of which are well known to one skilled in the art. In one embodiment of the invention preferred at present, illuminating means 18 comprises a plurality of spaced apart miniature lamps such as bulbs 38 in sockets 40. As presently preferred, the mounting for such bulbs and sockets comprises a piece of deformable material, shown in FIGS. 9 and 10 as compressible material 42, preferably foam rubber, disposed in a U-shaped groove 36 that extends about the inner periphery of member 22, preferably equidistant from mirrors 12 and 14. Compressible material 42 may be held in said groove by being press-fitted therein, or by means of an adhesive, or preferably by both. As shown in FIG. 10, the bulbs 38 and sockets 40 are secured in the compressible material 42 by being press-fitted in a plurality of spaced apart apertures 44, preferably along the entire length of said material.

Figure 17:
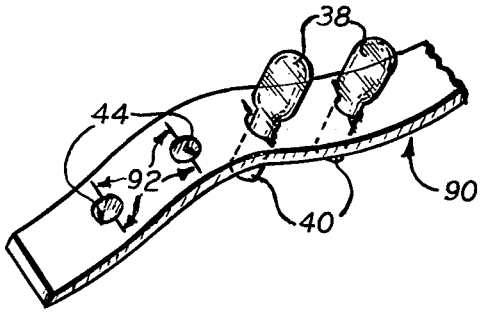
FIG. 17 is a fragmentary perspective view, similar to that of FIG. 10, but showing an alternate means for supporting the bulbs.

Alternatively, as shown in FIG. 17, the deformable material may comprise a strip of resilient material 90 having a plurality of spaced apart apertures 44 in which bulbs 38 and sockets 40 are secured. Each aperture 44 has at least one outwardly extending slot 92 communicating therewith and is slightly undersized for said sockets. When a socket is forced into an aperture, the resilient material will flex as permitted by the slots 92 to accommodate the socket which will be firmly held by the resiliency of the material. The resilient material may be, for example, vinyl although other materials can be employed.

Figure 2:
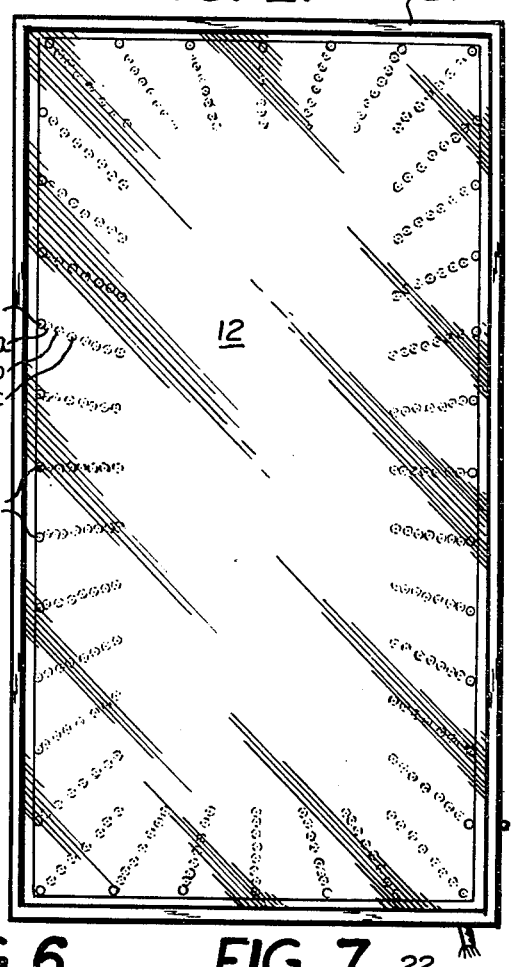
FIG. 2 is a front elevational view of said display device.
Figure 5:
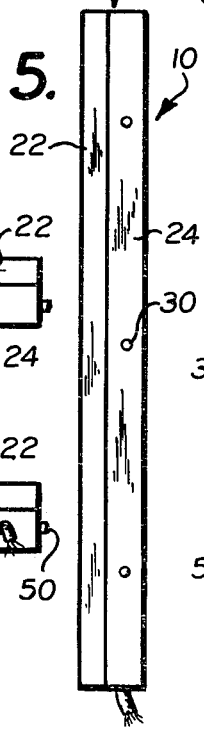
FIG. 5 is a side view looking from the left of FIG. 2.
Figure 6:
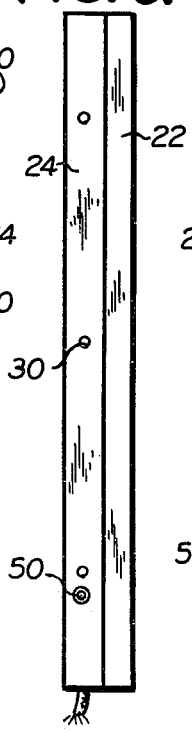
FIG. 6 is a side view looking from the right of FIG. 2.
Figure 7:
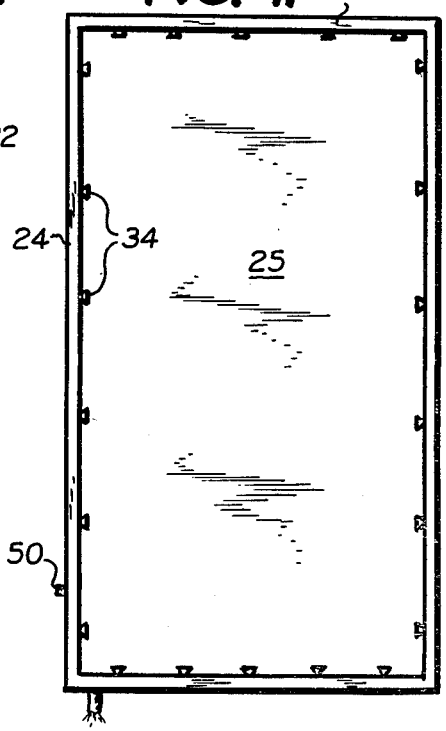
FIG. 7 is a rear elevational view thereof.
Figure 3:
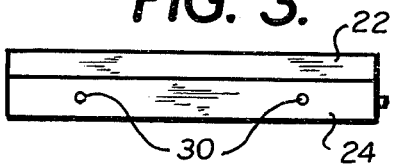
FIG. 3 is a top plan view thereof.
Figure 4:
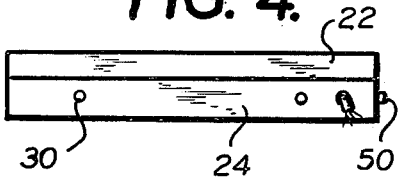
FIG. 4 is a bottom view thereof.

As presently preferred, power to the lamps 38 is supplied by wires 46, which wires are disposed in a second U-shaped groove 48 which is smaller than the groove 36. The smaller groove 48 is located outside the groove 36 and is in communication therewith. Power to the wires 46 is controlled by a switch 50 (shown in FIG. 2) connected to a suitable power source.

In operation, assuming the bulbs are deenergized, an observer will look into the front of partially silvered mirror 12 and all he will see is his image reflected off mirror 12. Upon bulbs 38 being energized by switch 50, part of the light from the bulbs 38 will be conducted through the partial mirror 12 allowing the observer to see the bulbs 38 and himself much as if he were looking through a darkened window. Most of the light from bulbs 38, however, preferably about 90% as noted above, is reflected back towards the fully silvered rear mirror 14, from which substantially all of the light is reflected back towards the partially silvered mirror 12. Of the light incident upon the front mirror 12, part is transmitted to the observer and part is again reflected back to the fully silvered rear mirror 14. The repetition of this process results in the occurrence of multiple reflections between the two mirrors.

Each time light from one of these multiple reflections strikes the front mirror 12, part of the light is transmitted to the observer causing him to see a series of virtual images (38A, 38B, 38C, etc. in FIG. 2), one behind the next, which virtual images appear to extend back far into the device. The effect of these multiple virtual images is to impart an illusion of depth to the observer, which is the primary objective of the display device 10.

Moreover, as noted above, the observer will also see his own image reflected from the mirror 12 which phenomenon further highlights the visual effect of the device.

Planar mirrors are preferred because their utilization results in the virtual images appearing to extend straight back into the device, one behind the next, thereby further enhancing the illusion of depth, although, as will be more fully discussed hereinafter, either or both of the mirrors may be non-planar where different visual effects are desired.

As pointed out above, the illuminating means 16 may take a variety of forms. In one alternate embodiment of the invention shown in FIG. 11, a continuous light source 58, preferably fluorescent or neon tubes, is suitable mounted in the device 10' to extend about preferably the entire inner periphery of the housing.

Referring now to FIG. 12, a modified form of display device is illustrated that incorporates all of the structure of the device of FIGS. 1 and 9. However, suitable indicia 54 are mounted within the housing means and between the mirrors 12 and 14 which indicia may be in the form of letters, numbers, illustrations or the like. The indicia are illuminated by the illuminating means 18 with the result that the observer will see multiple images of both the illuminating means and the indicia.

As shown in FIGS. 13 and 14, still another alternative according to the invention is illustrated. In accordance therewith, the opaque coating 80 on mirror 14 is provided with at least one gap 56, with illuminating means disposed behind the mirror for directing light through said gap. In addition to the opaque coating, and as described above, the mirror 14 is comprised of a reflective coating and a transparent substrate. Since said reflective coating is always partially conductive, of the light directed through said gap, part will be transmitted through said reflective coating and said transparent substrate and become incident upon the mirror 12, causing the light passing through said gap to be reflected between said mirrors. This will establish multiple virtual images of light in the shape of said gap to appear to extend back into the device as is more fully described above. If desired, and as is preferred, the said at least one gap may be in the shape of intelligible indicia such as numbers or letters. Of course, as shown, this alternative may be used in conjunction with other illuminating means disposed between the two mirrors, such as the miniature lamps described above. If desired some or all of the reflective coating in the gap may be removed to increase the amount of light from source 18 that passes through gap 56.

The actual degree of depth imparted to the observer is not infinite because of certain limitations inherent in the operation of the device. First, since each virtual image seen by the observer results from part of the light from each successive incidence upon the partially silvered front mirror 12 being transmitted to the observer, there is a decrease in the intensity of each successive virtual image. At some point, the intensity becomes so small that it cannot be perceived by the human eye. While increasing the intensity of the illuminating means increases the number of virtual images perceivable by the human eye, this alternative is limited by practical considerations of lamp brightness, heat generation, land life, and glare. Second, depending upon the reflectivity of the partially silvered front mirror 12, more or less light is transmitted to the observer on each successive incidence, and will determine how quickly the light intensity decreases. It is for this reason that the mirror 12 ideally reflects about 90% of the incident light, as this not only increases the number of virtual images seen by the observer and hence the illusion of depth imparted to him, but also allows enough light to be transmitted to the observer so that a large number of the virtual images will be clearly perceptible to him. Third, the intensity of the ambient light will further limit the number of virtual images perceivable. By viewing the device 10 in a darkened room, the ambient light may be all but eliminated, thus enhancing the visual effect. Fourth, further attenuation is caused by the fact that the material from which mirrors 12 and 14 are made, e.g. glass, absorbs some light upon each incidence of light thereon. This factor may be reduced by utilizing materials with low coefficients of absorption. Fifth, a slight attenuation is caused with each reflective event from energy losses in the form of heat.

The visual effect created by the device 10 may be further enhanced by applying a dichroic coating to one of the two mirrors, preferably the rear fully silvered mirror 14. The effect of this coating is to reflect substantially all of predetermined wavelengths of the light spectrum while transmitting the remainder. Because the coating does not act as a perfect filter, each successive virtual image will display a slightly different and more intense hue, further enhancing the aesthetic appeal of the illusion.

A similar effect may also be accomplished by coating the inner surfaces of either of the two mirrors, or both, with a transparent color. Such a coating produces a filtering effect by absorbing selected wavelengths of the light spectrum while transmitting the remainder. However, since the filtering effect produced by such a coating is imperfect, each passage of light through said coating will further intensify the hue of the transmitted light and hence of the virtual images associated therewith.

As a further alternative, this effect may be accomplished by utilizing a tinted transparent substrate, such as, for example, a piece of tinted glass, in the construction of either of the mirrors or both.

Figure 16:
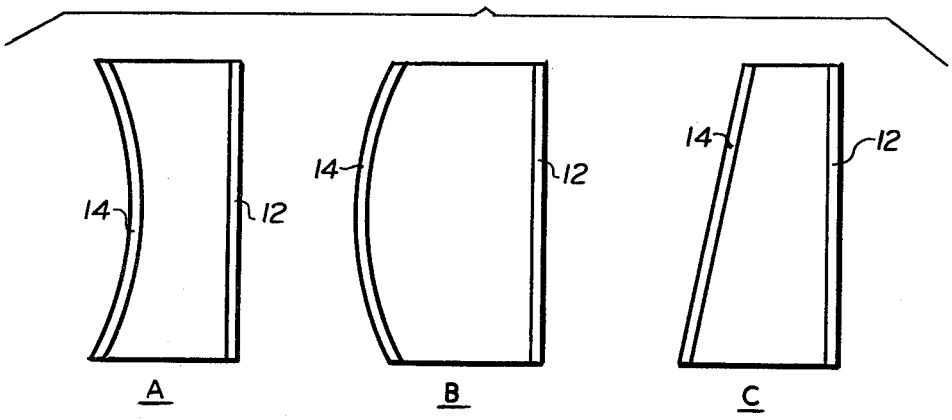
FIG. 16 A, B and C are schematic side views showing different mirror arrangements.

In still another embodiment of the invention either or both of the two mirrors may be non-planar. As shown in FIG. 16, only the rear mirror is non-planar so as not to distort the image of the observer. If the inner surface of the rear mirror 14 is slightly convex, as shown in FIG. 16 (greatly exaggerated for purposes of illustration), the virtual images of the illuminating means will appear to more rapidly converge than if the mirrors are both planar, and alternatively, if concave, FIG 16B, they will appear to diverge. Preferably, and as is shown in FIGS. 16A and 16B, the optical axis of the rear mirror is coincident with that of the front mirror. In those situations where distortion of the image of the observer is acceptable, either or both mirrors may be non-planar resulting in a variety of different visual effects depending upon the particular combination selected.

As shown in FIG. 16C, in still another embodiment of the invention the rear mirror 14 is at a small angle (greatly exaggerated for purposes of illustration) with respect to the plane of the front mirror 12, in which situation the virtual images appear to bend with a radius of curvature dependent on the angle between the planes of the two mirrors. Of course, as is more fully described above, the mirrors need not be planar in which case a number of additional combinations become readily apparent to those skilled in the art.

Figure 15:
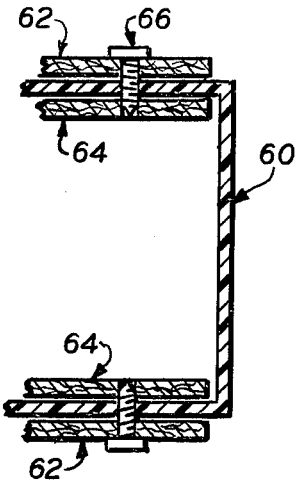
FIG. 15 is a fragmentary sectional view similar to FIG. 9 but showing only a modified front mirror construction.

As shown in FIG. 15, in another embodiment of the invention the front and rear mirrors are comprised of a partially silvered transparent plastic sheet or membrane 60, and a fully silvered transparent plastic sheet or membrane (not shown) respectively, said membranes being drawn taut on a supporting framing structure made of metal or other suitable material such as wood or plastic. In FIG. 15 the supporting framing structure is comprised of structure 62 and an inner framing structure 64, membrane 60 being secured therebetween by a plurality of distributed screws 66 or other fastening means well known to those skilled in the art. Such silvered transparent plastic sheets may be, for example, aluminized Mylar. Of course, it is possible to have only one of the two mirrors constructed in this manner, the other being constructed in any one of a number of ways well known to those skilled in the art as is more fully described above.

To further enhance the aesthetic effect, it is possible for the mirrors of the display device to take any number of peripheral shapes, such as for example, circular or elliptical, their construction not being limited to the rectangular periphery depicted in the drawings.

While I have herein shown and described the preferred embodiment of the present invention and have suggested modifications therein, other changes and modifications may be made therein within the scope of the appended claims without departing from the spirit and scope of this invention.

What is claimed is:

1. An illuminated display device comprising:

a partially silvered front mirror;

a rear fully silvered mirror, at least a portion of said rear mirror being in spaced apart confronting relation with at least a portion of said front mirror for defining a volume between said mirror confronting portions;

a housing in supporting relation with said front and rear mirrors for supporting said front and rear mirrors in said confronting relation; and illuminating means supported and distributed within said volume along the periphery thereof, said illuminating means comprising a plurality of discrete point light sources spaced along said periphery, whereby light from said point sources reflected back and forth between said front and rear mirrors creates an illusion of depth when viewed through said front mirror.

2. Display device of claim 1, wherein said mirrors are parallel planes.

3. Display device according to claim 1, wherein said mirrors are in parallel planes and said plurality of peripherally positioned discrete light sources are positioned in a plane parallel to said two mirrors.

4. Display device according to claim 3, wherein said plurality of peripherally positioned discrete light sources are approximately equidistant from each other.

5. Display device according to claim 3 wherein said mirrors are in register.

6. Display device according to claim 1, wherein said housing is secured to the peripheral edge portions of said front and rear mirrors, said housing having a peripherally extending groove between said front and rear mirrors, said illuminating means being mounted in said groove.

7. Display device according to claim 6, further comprising a strip of deformable material disposed in said groove, said illuminating means being secured in said deformable material.

8. Display device according to claim 7, wherein said deformable material is compressible and said compressible material is press-fitted in said groove.

9. Display device according to claim 7, wherein said deformable material is secured in said groove by means of an adhesive.

10. Display device according to claim 7, wherein said deformable material is provided with a plurality of apertures; and wherein said illuminating means is comprised of a plurality of discrete spaced apart light sources, and wherein said discrete light sources are secured to said deformable material by being press-fitted in said apertures.

11. Display device according to claim 1, wherein said partially silvered front mirror conducts between about 50% and 5% of incident light and reflects substantially the remainder.

12. Display device according to claim 1, wherein said partially silvered front mirror conducts about 10% of incident light and reflects substantially the remainder.

13. Display device according to claim 1, further comprising means secured within said housing for selectively absorbing a portion of the light spectrum emitted by said illuminating means and for transmitting substantially all of the remainder thereof.

14. Display device according to claim 13, wherein said selective absorption means is a dichroic coating applied to one surface of at least one of said mirrors.

15. Display device according to claim 13, wherein said selective absorption means is a colored transparent coating applied to one surface of at least one of said mirrors.

16. Display device according to claim 14, wherein said dichroic coating is applied to said rear mirror.

17. Display device according to claim 1, wherein at least one of said mirrors comprises a transparent glass substrate.

18. Display device according to claim 1, wherein at least one of said mirrors comprises a transparent flexible sheet substrate.

19. Display device according to claim 1, wherein at least one of said mirrors is curved.

20. Display device according to claim 1, wherein said rear mirror is curved.

21. Display device according to claim 1, wherein said rear mirror is in non-parallel relation to said front mirror.

22. Display device according to claim 1, wherein said housing means is opaque.

* * * * *